US005920920A

United States Patent [19]

Chi

[11] Patent Number: 5,920,920

[45] Date of Patent: Jul. 13, 1999

[54] STRAIGHT TRAP TOILET APPARATUS

[76] Inventor: Wei-Neng Chi, No. 100, Feng-Tung Road, Feng-Shan City, Kaohsiung Hsien, Taiwan

[21] Appl. No.: 08/986,930

[22] Filed: Dec. 8, 1997

[51] Int. Cl.[6] ..... E03D 11/10; E03D 5/08

[52] U.S. Cl. ..... 4/437; 4/308; 4/331; 4/415; 137/391; 137/413; 137/428; 137/430

[58] Field of Search ..... 4/434, 435, 300, 4/324, 325, 308, 311, 331, 378, 405, 415, 437; 137/409, 391, 428, 430, 413

[56] References Cited

U.S. PATENT DOCUMENTS

| | | | |
|---|---|---|---|
| Re. 10,377 | 8/1883 | Milne et al. | 4/331 |
| 23,335 | 3/1859 | Wellington | 4/300 |
| 244,535 | 7/1881 | Blackwood, Jr. | 4/437 |
| 255,975 | 4/1882 | Hanson | 4/435 |
| 292,918 | 2/1884 | Kelly | 4/300 |
| 365,937 | 7/1887 | Park | 4/331 |
| 1,614,346 | 1/1927 | Coret | 4/308 X |
| 1,615,523 | 1/1927 | Shimo | 4/308 X |
| 4,868,931 | 9/1989 | Schneeweiss | 4/308 |
| 5,201,082 | 4/1993 | Rockwell | 4/434 X |
| 5,657,495 | 8/1997 | Dufresne | 4/435 X |

*Primary Examiner*—Henry J. Recla
*Assistant Examiner*—Kathleen J. Prunnner
*Attorney, Agent, or Firm*—Bacon & Thomas, PLLC

[57] ABSTRACT

A straight trap toilet apparatus mainly comprises a main body with a straight trap, a piston, and a toilet bowl. The water outlet of the main body is connected to a waste pipe, and the top of the main body is mounted below the toilet bowl. The main body has a water valve, wherein one end of the water valve is connected to an inlet tube connected to a water-faucet, and the other end of the water valve is connected to an outlet tube that corresponds to the spurt water hole of the toilet bowl. In normal condition, water flows from the outlet tube into the toilet bowel and the main body. A water tank is in fluid communication with the main body by a linking tube such that the water in the toilet bowel and the water tank are at the same level. The motion of the float ball will control a valve handle to control the water valve for controlling the water intake. The water from the outlet tube may gather together in the main body, the toilet bowel, and is in fluid communication with the water tank by a linking tube. The water in the main body is drained from a drainage outlet which is controlled by a piston. When in use, the user treads the treadle of a controlling handle, and the piston will open the drainage outlet and feces or excreta will be flushed out very quickly.

5 Claims, 4 Drawing Sheets

STRAIGHT TRAP TOILET APPARATUS

BACKGROUND OF THE INVENTION

1. Field of the Invention

The present invention relates to a straight trap toilet apparatus and, more particularly, to a straight trap toilet apparatus which may flush out the feces or the filth with less water and will not stink with the feces.

2. Description of the Related Art

Conventional toilet utilizes the water in the toilet tank to scrub and flush out the feces and the filth through the waste pipe into the fertilizer pool. In order to avoid stink of the feces, the conventional toilet bowl is usually designed as siphon-type with a "S" shape trap such that the curve trap accumulates water to form an obstacle for the stink from the waste pipe. However, as the conventional siphon-type toilet needs a large quantity of water to flush out the feces from the toilet bowel through the trap into the waste pipe, the toilet is easily blocked, and consumes a large quantity of water.

The present invention is intended to provide a straight trap toilet apparatus which mitigates and/or obviates the above problems.

SUMMARY OF THE INVENTION

It is a main object of the present invention to provide a straight trap toilet apparatus which may flush out the feces or the filth with less water.

It is another object of the present invention to provide a straight trap toilet apparatus which will not stink with the feces.

The straight trap toilet apparatus in accordance with the present invention mainly comprises a main body with a straight trap, a piston, and a toilet bowl. The water outlet of the main body is connected to a waste pipe, and the top of the main body is mounted below the toilet bowl. The main body has a water valve, wherein one end of the water valve is connected to an inlet tube connected to a water-faucet, and the other end of water valve is connected to an outlet tube that corresponds to the spurt water hole of toilet bowl. In normal condition, water flows from the outlet tube into the toilet bowel and the main body. A water tank is in fluid communication with the main body by a linking tube such that the water in the toilet bowel and the water tank are at the same level. The motion of the float ball will control a valve handle to control the water valve for controlling the water intake. The water from the outlet tube may gather together in the main body, the toilet bowel, and is in fluid communication with the water tank by a linking tube. The water in the main body is drained from a drainage outlet which is controlled by a piston. When in use, the user only treads the treadle of a controlling handle, the piston will open the drainage outlet and feces or excreta will be flushed out totally in about two seconds.

Other objects, advantages, and novel features of the invention will become more apparent from the following detailed description when taken in conjunction with the accompanying drawings.

BRIEF DESCRIPTION OF THE DRAWINGS

The invention can be more fully understood by reading the following detailed description of the preferred embodiments, with reference made to the accompanying drawings, wherein.

DETAILED DESCRIPTION OF THE PREFERRED EMBODIMENT

Figure 1:
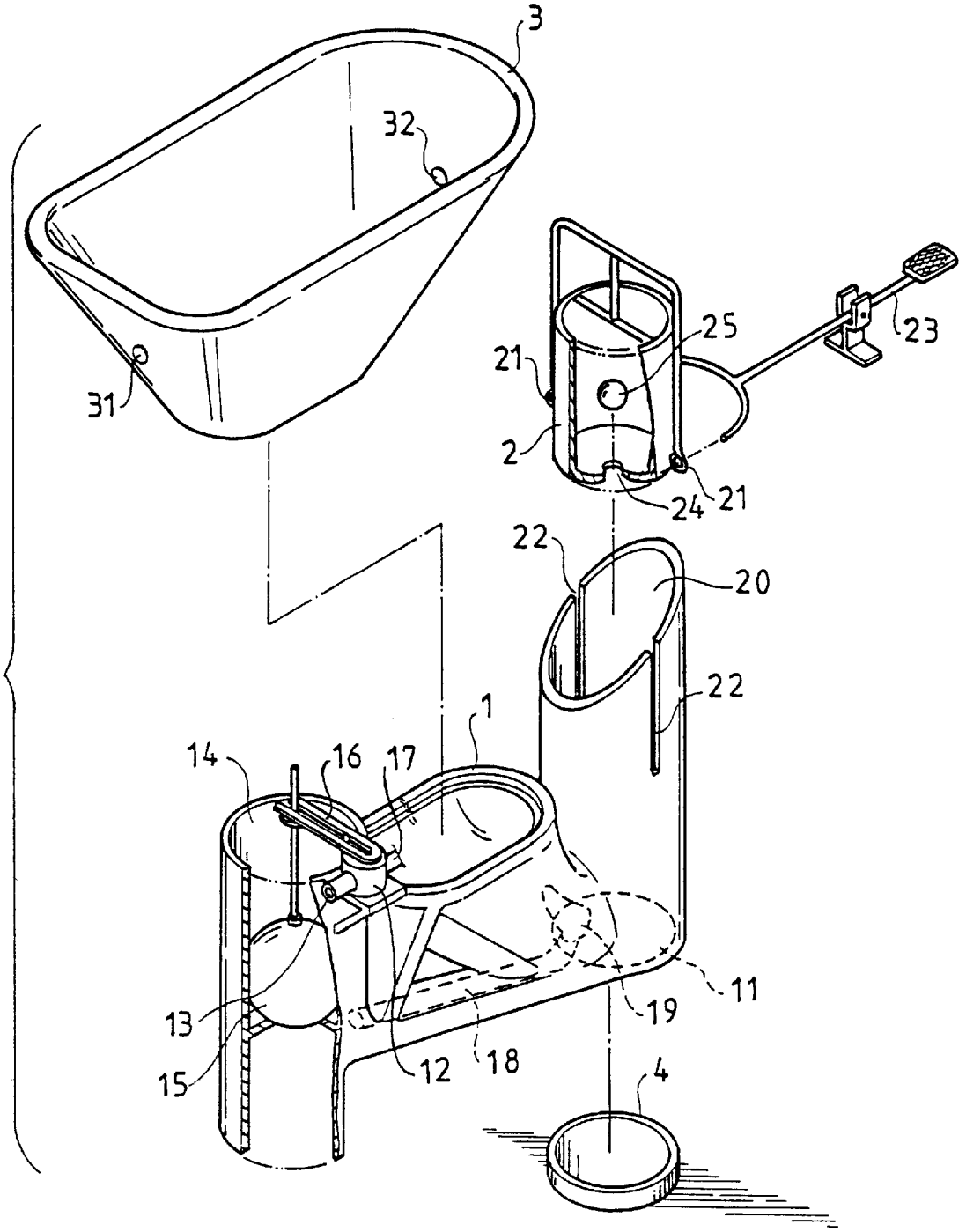
FIG. 1 is an exploded perspective view of a straight trap toilet apparatus in accordance with the present invention.
Figure 2:
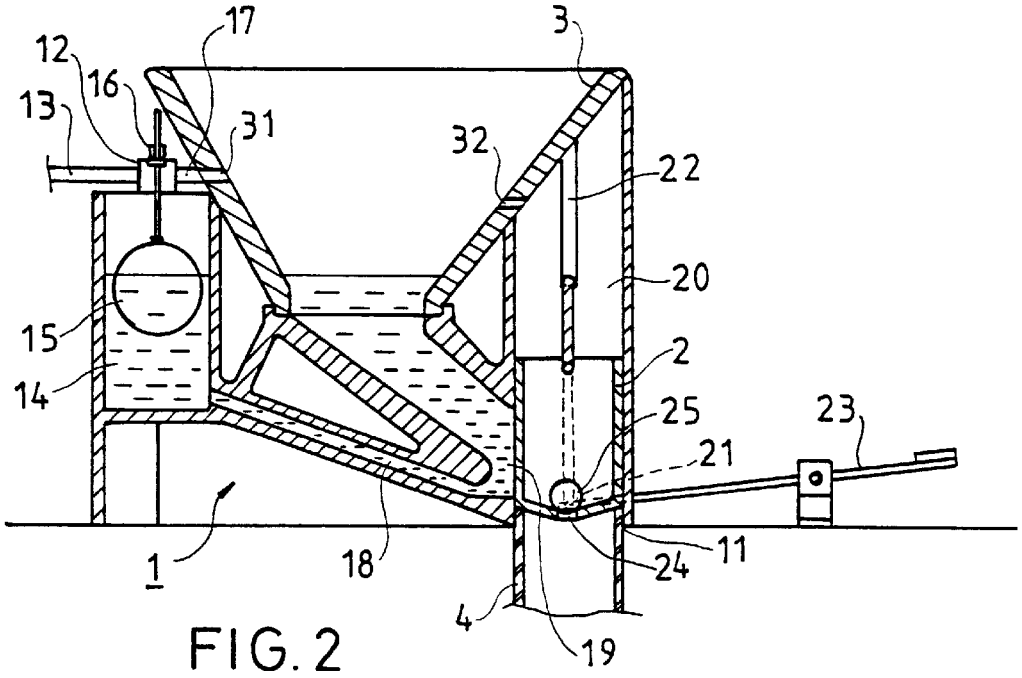
FIG. 2 is a cross-section view of the straight trap toilet apparatus in closed state in accordance with the present invention.

Referring to FIGS. 1 and 2, there is shown an exploded perspective view of the straight trap toilet apparatus in accordance with the present invention which mainly comprises a main body 1, a piston 2, and a toilet bowl 3. The water outlet 11 of the main body 1 is connected to waste pipe 4, and the top of the main body 1 is mounted below the toilet bowl 3. The main body 1 has a water valve 12, wherein one end of the water valve 12 is connected to an inlet tube 13 connecting to a water-faucet, and the other end of water valve 12 is connected to an outlet tube 17 that corresponds to the spurt water inlet hole 31 of toilet bowl 3. In normal condition, water flows from the outlet tube 17 into the toilet bowel 3 and the main body 1. A water tank 14 is in fluid communication with the main body 1 by a linking tube 18 such that the water in the toilet bowel 3 and the water tank 14 are at the same level. Inside the water tank 14 is provided with a float ball 15, wherein the float ball 15 may fall down depending on its weight and is lifted by the buoyancy of water. The motion of the float ball 15 will control a valve handle 16 to control the water valve 12 for controlling the water intake from the inlet tube 13. The water from the outlet tube 17 may gather together in the toilet bowel 3 and the main body 1, and is in fluid communication with the water tank 14 by a linking tube 18, wherein the lining tube 18 is a tube of which the diameter is about 10 cm, and connects the water tank 14 and the main body 1 for accumulating suitable water in the main body 1. In general, the surface width of the water is about 20 cm to 25 cm, and the depth of water is above 7.5 cm. The water in the main body 1 is drained from a drainage outlet 19 which is controlled by a piston 2. When in use, the user only treads the treadle of a controlling handle 23, and the piston 2 will open the drainage outlet 19 and feces or excreta will be flushed out totally in about two seconds.

The piston 2 is disposed at a piston chamber 20 of the main body 1, and a pair of guide handles 21 of the piston 2 moves vertically inside the concavity 22 of piston chamber 20. The piston 2 may close or open the drainage outlet 19, and the piston 2 is controlled by the controlling handle 23. The piston 2 itself is a hollow cylinder and has a drainage hole 24 in the bottom portion, wherein the drainage hole 24 is disposed at the lowest position of the piston 2, and is closed by a ball 25 to prevent the stink from the waste pipe 4.

The toilet bowl 3 is used for receiving and containing feces or filth, and is mounted above the main body 1. The toilet bowl 3 comprises a spurt water hole 31 corresponding to the outlet tube 17 of the main body 1 and an overflow tube 32. When the water valve 12 can not close, the water will flow from overflow outlet hole 32 into the piston chamber 20 and the ball 25 will be floated up by the buoyancy of water such that the drainage hole 24 is open and the overflow water flows from the drainage hole 24 to the waste pipe 4.

Now referring to FIG. 2 again, it shows that the present invention is in the normal reservoir state. In this state, the water valve 12 opens, the water flows through the outlet tube 17 into the main body 1, and the drainage outlet 19 is blocked by the piston 2 such that the water is kept inside the main body 1 and the float ball 15 is floated to a proper position to close the water valve 12 to stop the water intake from the inlet tube 13. Therefore, the water accumulates in the the toilet bowel 3, the main body 1 and the water tank 14. Accordingly, the stink from the waste pipe 4 is blocked by the water inside the main body land the drainage hole 24, and can not escape therefrom.

Figure 3:
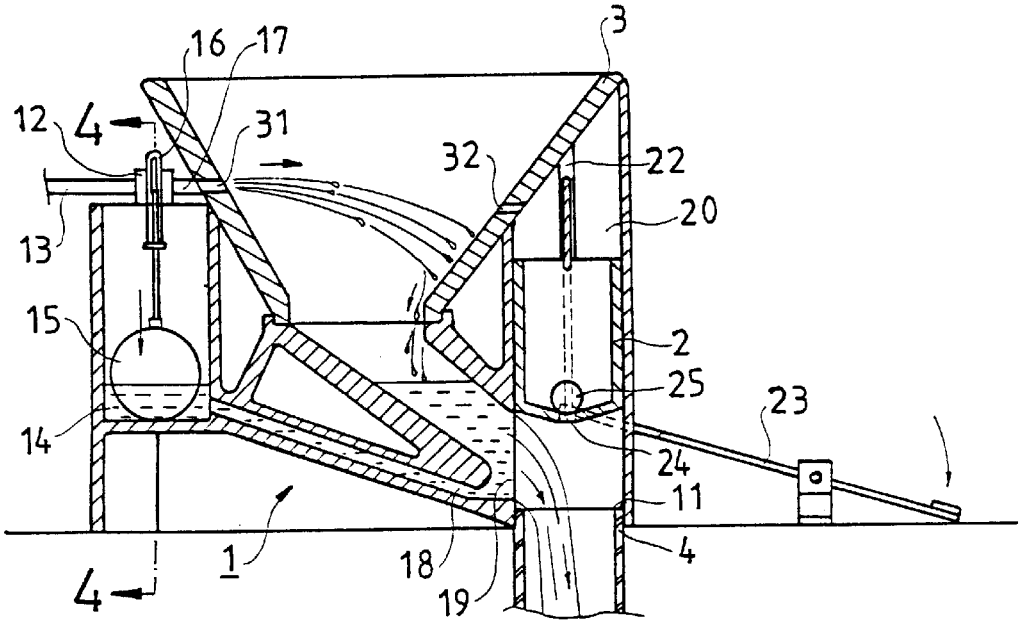
FIG. 3 is a cross-section view of the straight trap toilet apparatus in open state in accordance with the present invention.

Furthermore, referring to FIG. 3, showing a cross-section view of the straight trap toilet apparatus in an open state in accordance with the present invention. As showing in the FIG. 3, when there is feces or filth in the main body 1, the user can press or tread the controlling handle 23 to lift the piston 2 so as to open the drainage outlet 19. The feces, the filth and the water in the main body 1 are flushed out through the drainage outlet 19 into the waste pipe 4 quickly. At the same time, the water valve 12 is open and the water continues spurting from the outlet tube 17 to flush out the feces inside the toilet bowel 3.

Figure 4:
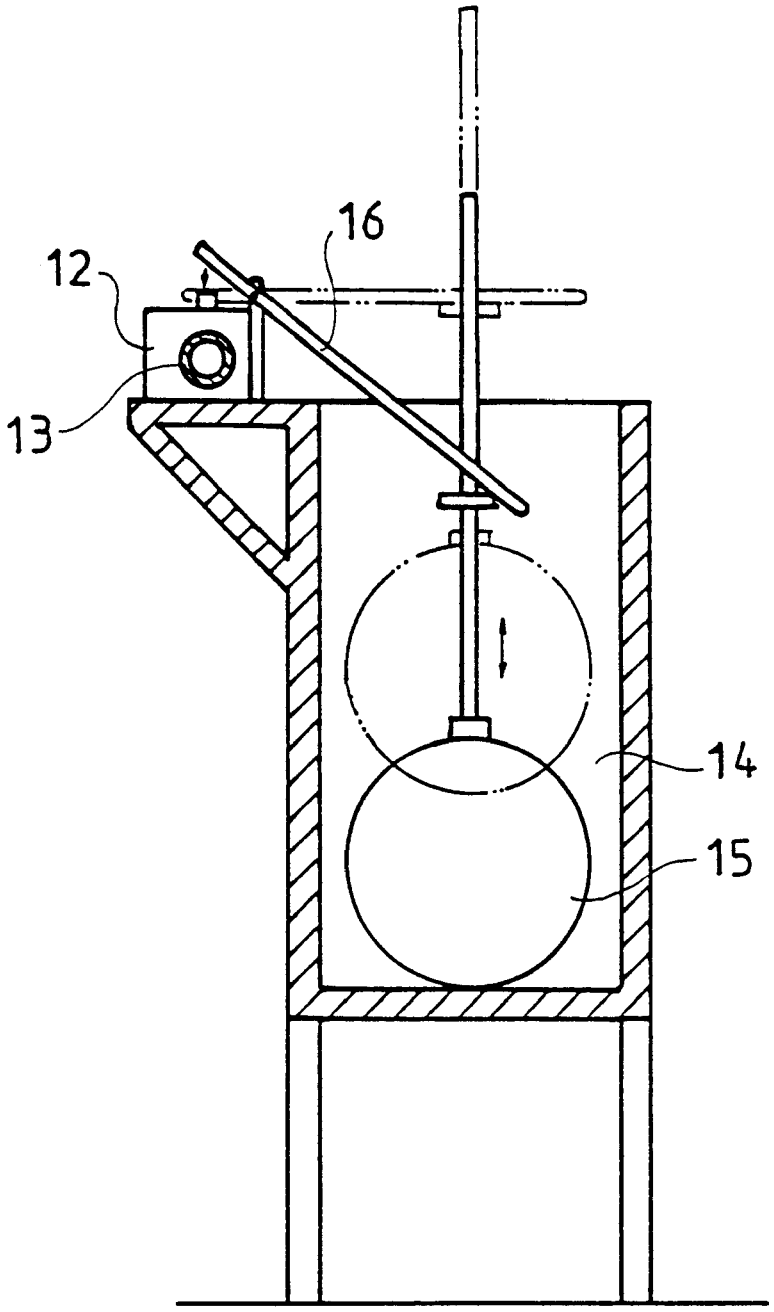
FIG. 4 is a cross-section view along the 4—4 line of FIG. 3 in accordance with the present invention.

Further referring to FIG. 4, it shows a cross-section view along the 4—4 line of FIG. 3. Water flows from the inlet tube 13 through the water valve 12 and the outlet tube 17 into the water tank 14. The float ball 15 is provided in the water tank 14 to control the water valve. The position of the float ball 15 changes corresponding to the water level in the water tank 14. The float ball 15 is connected to a valve handle 16 to control the water valve 12.

Figure 5:
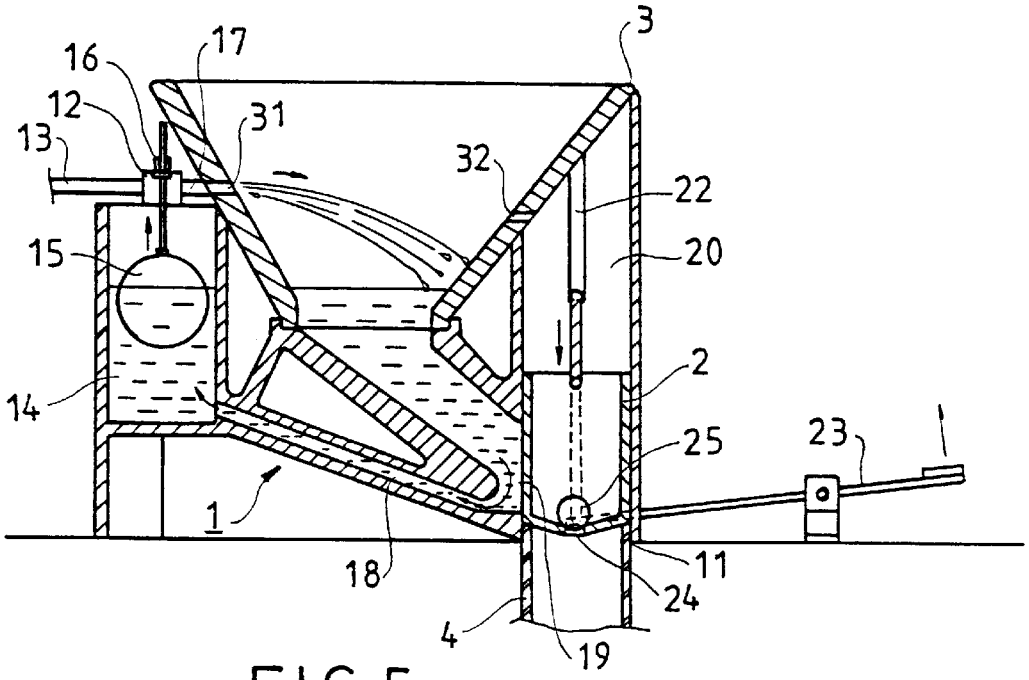
FIG. 5 is a cross-section view of the straight trap toilet apparatus in accordance with the present invention when the water is in normal state.

FIG. 5 is a cross-section view of the straight trap toilet apparatus in accordance with the present invention when the water is in a normal or accumulating state. When the pressing action on the controlling handle 23 is released, the piston 2 returns back to its original position to close the drainage outlet such that the water through outlet tube 17 can accumulate in the main body 1, the toilet bowl 3 and the water tank 14 again. When the water in the water tank 14 reaches to its predetermined intake level, the float ball 15 together the valve handle 16 close the water valve 12. At this time, the ball 25 in the piston 2 also closes the drainage hole 24, so the stink from the waste pipe 4 can not escape therefrom.

Figure 6:
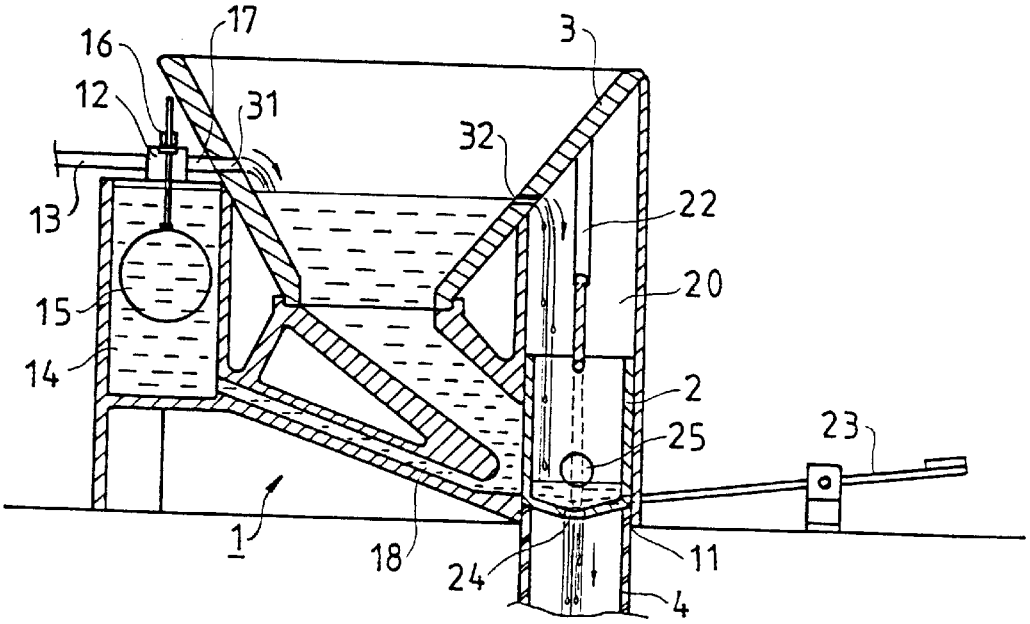
FIG. 6 is a cross-section view of the straight trap toilet apparatus in accordance with the present invention when the water is in overflow state.

FIG. 6 is a cross-section view of the straight trap toilet apparatus in accordance with the present invention when the water is in an overflow state. When the water valve 12 fails to close the water from the inlet tube 13 to the outlet tube 17, the water inside the water tank 14 will flow into the piston chamber 20 from the overflow outlet hole 32. Accordingly, the ball 25 inside piston chamber 20 is floated up by the buoyancy of water, and the drainage hole 24 is open such that the water can flow into the waste pipe 4.

The straight trap toilet apparatus of the present invention can flush out the feces or the filth with less water and will not stink with the feces from the waste pipe. In view of the above descriptions, the advantages and features of the present invention are summarized as follows:

1. The present invention only requires about 2.5 to 3 liters of water to flush out the feces each time. Accordingly, it may save above two thirds water as compared with the conventional siphon-type toilet.
2. The diameter of linking tube is about 10 cm, so it will not be blocked by the filth.
3. The surface width of the water in the toilet bowl is about 20 cm to 25 cm, and the depth of the water is above 7.5 cm,. It is easy to clean and no stink will come out from the waste pipe.

While there has been shown and described a preferred embodiment of the straight trap toilet apparatus in accordance with the present invention, it will be appreciated that many changes or modifications may be made thereto without, however, departing from the spirit of the present invention. It is to be distinctly understood that the present invention is not limited thereto, but may be otherwise variously embodied and practiced within the scope of the following claims.

What is claimed is:

1. A straight trap toilet apparatus comprising:

a) a toilet bowl provided with a spurt water inlet hole and an overflow outlet hole;

b) a main body mounted below the toilet bowl, the main body including a drainage outlet extending downwardly from the toilet bowl for draining water and waste therefrom to a waste pipe;

c) a water tank;

d) a linking tube providing fluid communication between the water tank and the drainage outlet;

e) a water inlet tube for directing water into the toilet bowl through the spurt water inlet hole, a valve for terminating water flow through the inlet tube in response to the level of water in the water tank;

f) a hollow piston at the drainage outlet, the piston being disposable in a first position for opening the drainage outlet and a second position for closing the drainage outlet, the piston normally being maintained in the second position, a control handle for operating by a user to dispose the piston in the first position, the piston further including a drainage hole, a float ball normally closing off the drainage hole, whereby when the level of water in the toilet bowl reaches the overflow outlet hole, the water passes through the overflow outlet hole and into the piston, thereby causing the ball float to open the drainage hole and permit the water contained in the piston to be discharged into the waste pipe.

2. The apparatus of claim 1 wherein the valve includes a float for actuating the valve, and the float being disposed within the water tank.

3. The toilet apparatus of claim 1 wherein the linking tube has a diameter of about 10 cm.

4. The apparatus of claim 1 wherein the toilet bowl has a surface width for water of about 20 cm to 25 cm, and a depth for water above 7.5 cm.

5. The apparatus of claim 1 wherein the control handle is foot-operated by the user.

* * * * *